US011525646B1

(12) United States Patent
Huang

(10) Patent No.: US 11,525,646 B1
(45) Date of Patent: Dec. 13, 2022

(54) OPTICAL TRIGGER FOR BOWS, CROSSBOWS AND FIREARMS

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 17/558,346

(22) Filed: Dec. 21, 2021

(51) Int. Cl.

| | |
|---|---|
| ***F41A 19/10*** | (2006.01) |
| ***F41A 17/46*** | (2006.01) |
| ***F41B 5/14*** | (2006.01) |
| ***F41A 19/16*** | (2006.01) |

(52) U.S. Cl.
CPC ..... *F41A 19/10* (2013.01); *F41A 17/46* (2013.01); *F41A 19/16* (2013.01); *F41B 5/1469* (2013.01)

(58) Field of Classification Search
CPC ..... F41A 19/10; F41A 19/16; F41B 5/1469
USPC ..... 42/84
See application file for complete search history.

(56) References Cited

U.S. PATENT DOCUMENTS 10,962,320 B1 * 3/2021 Burdine ..... F41A 19/69

* cited by examiner

*Primary Examiner* — Reginald S Tillman, Jr.
(74) *Attorney, Agent, or Firm* — Donald J. Ersler

(57) ABSTRACT

An optical trigger for bows, crossbows and firearms preferably includes a trigger member, a light source and a light receiver. The trigger member is pivotally retained relative to at least one surface with a pivot rod. The trigger member preferably includes a pull area and an actuation area. An actuation hole is preferably formed above a pivot point. The actuation hole allows light to travel from the light source to the light receiver. The light source and the light receiver are retained relative to one of first and second sides of the trigger member. One end of a spring is engaged with an edge of the actuation area and the other end is retained relative to a support surface. It is preferable to have a light shield located on opposing sides of the trigger member. Each light shield surrounds the actuation hole and the light source or light receiver.

20 Claims, 2 Drawing Sheets

OPTICAL TRIGGER FOR BOWS, CROSSBOWS AND FIREARMS

BACKGROUND OF THE INVENTION

1. Field of the Invention

The present invention relates generally to projectile firing devices and more specifically to an optical trigger for bows, crossbows and firearms, which includes an adjustable pull distance for releasing an arrow or a firing pin.

2. Discussion of the Prior Art

Trigger mechanisms are used in string releases and firearms. The process of pulling the trigger is critical in the aim of the projectile being fired from a bow, crossbow a firearm or any projectile launching device. However, trigger mechanisms in crossbows are similar to trigger mechanisms in firearms. String releases include triggers that do not require a high amount of pull force to release the bowstring. The above trigger mechanisms are dependent upon an interaction between numerous mechanical parts. It is common for shooters to have the sear surfaces of their firearms polished to eliminate roughness or grittiness due to machining sear surfaces during manufacture. It is advantageous to eliminate the feeling caused by a rough sear mechanism or a vibration generated by pulling the trigger. Insulating the shooter from feeling any roughness in the trigger mechanism will provide a more fluid trigger pull, which produces a more accurate shot.

Accordingly, there is a clearly felt need in the art for an optical trigger for bows, crossbows and firearms which eliminates the friction from multiple mechanical parts interacting with each other in a trigger mechanism and the ability to change the pull distance for releasing an arrow or a firing pin.

SUMMARY OF THE INVENTION

The present invention provides an optical trigger for bows, crossbows and firearms which eliminates the friction from multiple mechanical parts interacting with each in a trigger mechanism. The optical trigger for bows, crossbows and firearms (optical trigger) preferably includes a trigger member, a light source and a light receiver. The trigger member is pivotally retained between a first plate and a second plate with a pivot rod or the like. However, the trigger member could be pivotally retained relative to at least one surface. The trigger member preferably includes a flat plate having a substantially comma perimeter shape. The substantially comma perimeter shape includes a pull area and an actuation area. An actuation hole is preferably formed above pivot point. The actuation hole allows light to travel from the light source to the light receiver. The light source is retained in the first plate or the second plate. The light receiver is retained in the second plate or the first plate.

One end of a spring is engaged with an edge of the actuation area and the other end is retained by at least one of the first and second plates. The spring biases the trigger to be in a non-pulled position. It is preferable to have a light shield located on opposing sides of the trigger member. Each light shield is located between one side of the trigger member and one of the first or second plates. Each light shield surrounds the actuation hole and the light source or light receiver. The light shield prevents natural or artificial light from entering the light receiver and causing a false release of the arrow or bullet. A safety pin may be inserted into the trigger member to prevent movement of the trigger member. Further, a power switch is preferably used to only allow the light receiver to be powered, before a user is going to pull the trigger member.

Accordingly, it is an object of the present invention to provide an optical trigger, which eliminates the friction from multiple mechanical parts interacting with each other in a trigger mechanism.

Finally, it is another object of the present invention to provide an optical trigger, which includes the ability to change the pull distance for releasing an arrow or a firing pin.

These and additional objects, advantages, features and benefits of the present invention will become apparent from the following specification.

DETAILED DESCRIPTION OF THE PREFERRED EMBODIMENTS

Figure 1:
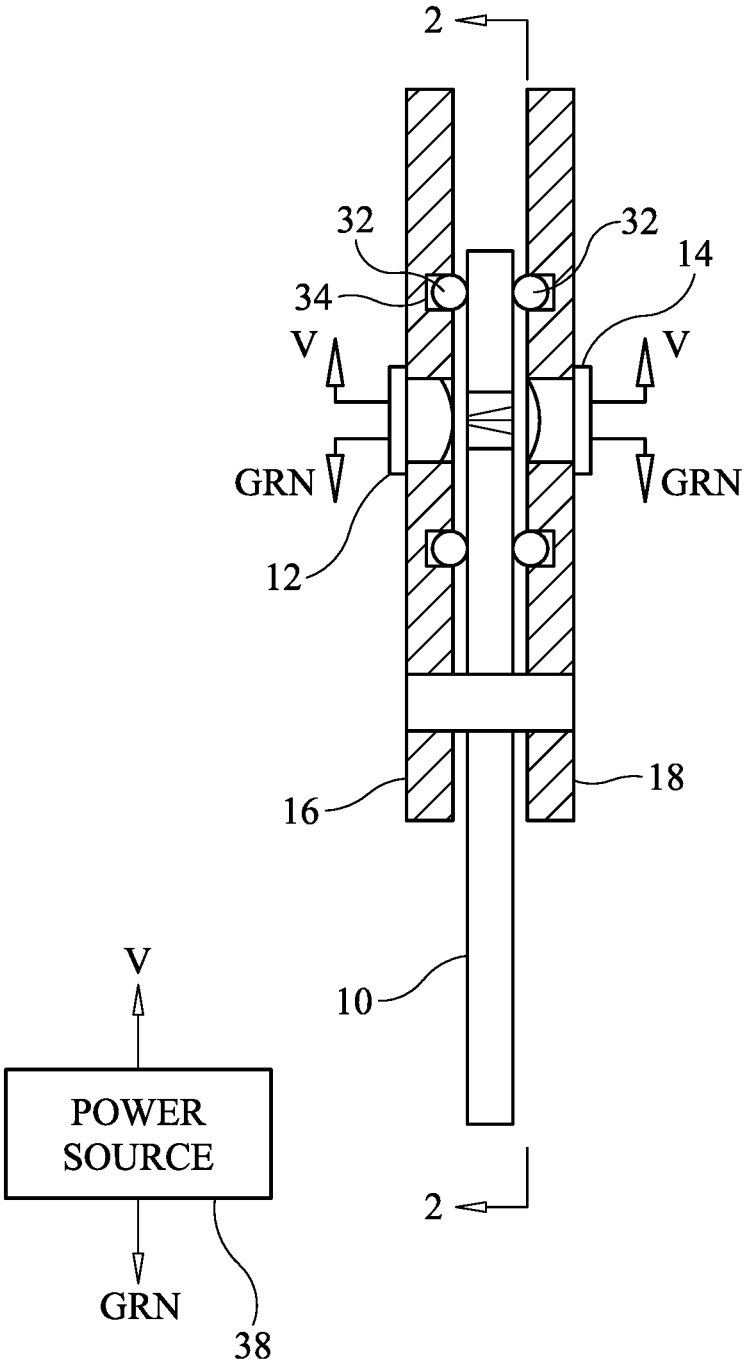
FIG. 1 is a partially exploded end view of an optical trigger in accordance with the present invention.
Figure 2:
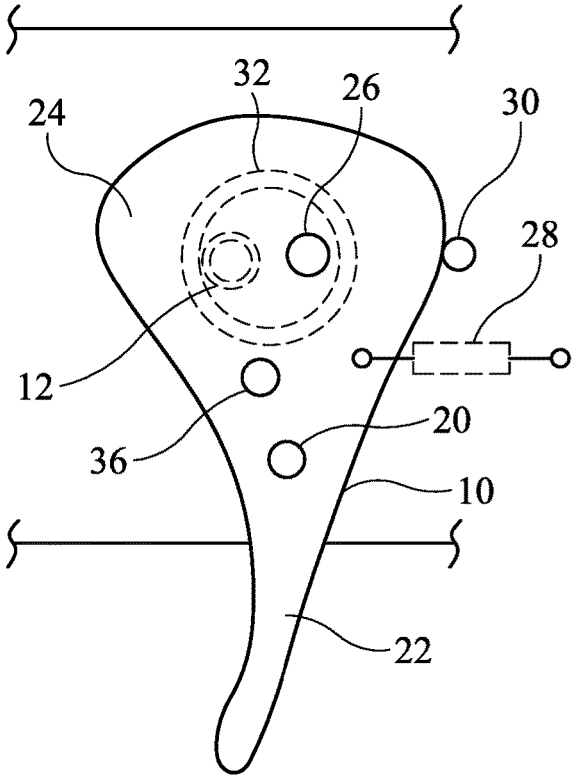
FIG. 2 is a front view of a trigger member of an optical trigger in a non-firing position in accordance with the present invention.

With reference now to the drawings, and particularly to FIG. 1, there is shown an end view of an optical trigger 1. With reference to FIG. 2, the optical trigger 1 preferably includes a trigger member 10, a light source 12 and a light receiver 14. The light source 12 may be any suitable LED. The light receiver may be any suitable photoelectric sensor. The trigger member 10 is pivotally retained between a first plate 16 and a second plate 18 with a pivot rod 20 or the like. However, the trigger member 10 could be pivotally retained relative to at least one surface. The trigger member 10 preferably includes a flat plate having a substantially comma perimeter shape. The substantially comma perimeter shape includes a pull area 22 and an actuation area 24. An actuation hole 26 is preferably formed above pivot point, but could be formed below the pivot point. The actuation hole 26 allows light to travel from the light source 12 to the light receiver 14. The light source 12 is retained in the first plate 16 or the second plate 18. The light receiver 14 is retained in the second plate 18 or the first plate 16.

One end of a spring 28 is engaged with an edge of the actuation area 24 and the other end is retained by at least one of the first and second plates 16, 18. The spring 28 biases the trigger member 10 to be in a non-pulled position. A stop pin 30 may be used to limit the travel from the biasing 28. It is preferable to have a light shield 32 located on opposing sides of the trigger member 10. The light shield 32 may be an o-ring, a brush, an elastic loop or any other suitable device. A light shield groove 34 is preferably formed in the first and second plates 16, 18 to receive each light shield 32, located between one side of the trigger member 10 and one of the first or second plates 16, 18. Each light shield 32 surrounds the actuation hole 26 and the light source 12 or light receiver 14. The light shield 32 prevents natural or artificial light from entering the light receiver 14 and causing a false release of the arrow or firing pin.

Figure 3:
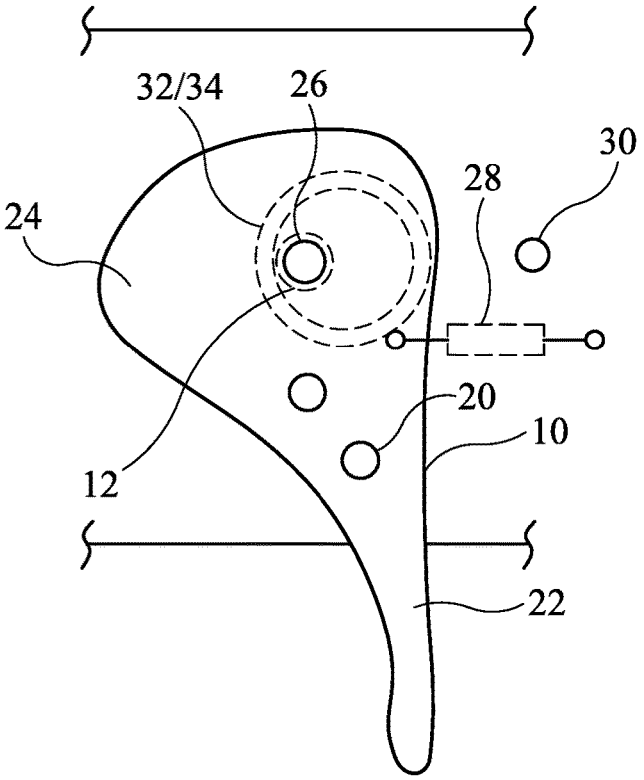
FIG. 3 is a front view of a trigger member of an optical trigger in a firing position in accordance with the present invention.

A safety pin 36 may be inserted into the trigger member 10 during non-use to prevent movement of the trigger member 10. Further, a power switch 38 is preferably used to only allow the light emitting device 12 and the light receiver 14 to be powered, before a user is going to pull the trigger member 10. With reference to FIG. 3, the trigger member 10 is rotated to a fire position to allow light from the light emitting device 12 to pass through the actuation hole to trigger the light receiver 14. The light receiver 14 may be adjusted to require a pre-defined amount of light to be received from the light emitting device 12, before releasing an arrow or firing pin. Thus, the angular travel of the trigger member 10 may be changed to adjust the distance of pull for releasing an arrow or firing pin by adjusting the light receiver 14.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An optical trigger for a projectile launching device, comprising:

a trigger member is pivotally engaged with at least one surface of the projectile launching device, a light opening is formed through said trigger member;

a light emitting device is positioned on one side of said trigger member; and a light receiving device is positioned on an opposing side of said trigger member, wherein said light emitting device and said trigger member are electrically powered, said light receiving device receives light through said light opening from said light emitting device when said trigger member is pivoted.

2. The optical trigger for a projectile launching device of claim 1 wherein:

a spring for biasing said trigger member to a non-firing position.

3. The optical trigger for a projectile launching device of claim 1, further comprising:

a safety pin for preventing movement of said trigger member.

4. The optical trigger for a projectile launching device of claim 1, further comprising:

a stop pin for supporting said trigger member in a non-firing position.

5. The optical trigger for a projectile launching device of claim 1, further comprising:

an electrical power source for powering said light emitting device and said light receiver.

6. The optical trigger for a projectile launching device of claim 1 wherein:

said light receiving device is adjustable to trigger when receiving a predetermined amount of light.

7. An optical trigger for a projectile launching device, comprising:

a trigger member is pivotally engaged with at least one surface of the projectile launching device, a light opening is formed through said trigger member above a pivot point;

a light emitting device is positioned on one side of said trigger member; and a light receiving device is positioned on an opposing side of said trigger member, wherein said light emitting device and said trigger member are electrically powered, said light receiving device receives light through said light opening from said light emitting device when said trigger member is pivoted.

8. The optical trigger for a projectile launching device of claim 7 wherein:

a spring for biasing said trigger member to a non-firing position.

9. The optical trigger for a projectile launching device of claim 7, further comprising:

a safety pin for preventing movement of said trigger member.

10. The optical trigger for a projectile launching device of claim 7, further comprising:

a stop pin for supporting said trigger member in a non-firing position.

11. The optical trigger for a projectile launching device of claim 7, further comprising:

an electrical power source for powering said light emitting device and said light receiver.

12. The optical trigger for a projectile launching device of claim 7 wherein:

said light receiving device is adjustable to trigger when receiving a predetermined amount of light.

13. An optical trigger for a projectile launching device, comprising:

a trigger member is pivotally engaged between two opposing surfaces of the projectile launching device, a light opening is formed through said trigger member;

a light shield is located between each surface of said two opposing surfaces and a side of said trigger member;

a light emitting device is positioned on one side of said trigger member; and a light receiving device is positioned on an opposing side of said trigger member, wherein said light emitting device and said trigger member are electrically powered, said light receiving device receives light through said light opening from said light emitting device when said trigger member is pivoted.

14. The optical trigger for a projectile launching device of claim 13 wherein:

a spring for biasing said trigger member to a non-firing position.

15. The optical trigger for a projectile launching device of claim 13 wherein:

a light shield groove is formed in said opposing surfaces to receive said light shield.

16. The optical trigger for a projectile launching device of claim 13 wherein:

said light shield is one of an o-ring, a brush or an elastic loop.

17. The optical trigger for a projectile launching device of claim 13, further comprising:

a safety pin for preventing movement of said trigger member.

18. The optical trigger for a projectile launching device of claim 13, further comprising:

a stop pin for supporting said trigger member in a non-firing position.

19. The optical trigger for a projectile launching device of claim 13, further comprising:

an electrical power source for powering said light emitting device and said light receiver.

20. The optical trigger for a projectile launching device of claim 13 wherein:

said light receiving device is adjustable to trigger when receiving a predetermined amount of light.

* * * * *